US009447337B2

(12) United States Patent
Steele et al.

(10) Patent No.: US 9,447,337 B2
(45) Date of Patent: Sep. 20, 2016

(54) FUEL SLURRY HEATING SYSTEM AND METHOD

(75) Inventors: Raymond Douglas Steele, Houston, TX (US); Sivaguru Kanniappan, Pondicherry (IN); Raul Eduardo Ayala, Houston, TX (US); Zhaohui Yang, Shanghai (CN); Dejia Wang, Shanghai (CN); Yan Zhou, Shanghai (CN); Karunagaran Sivagurunathan, Bangalore (IN); Murugaraja Sengottaiyan, Bangalore (IN)

(73) Assignee: General Electric Company, Schenectady, NY (US)

( * ) Notice: Subject to any disclaimer, the term of this patent is extended or adjusted under 35 U.S.C. 154(b) by 165 days.

(21) Appl. No.: 13/522,312

(22) PCT Filed: Aug. 19, 2011

(86) PCT No.: PCT/CN2011/001380

§ 371 (c)(1),
(2), (4) Date: Jul. 13, 2012

(87) PCT Pub. No.: WO2013/026176

PCT Pub. Date: Feb. 28, 2013

(65) Prior Publication Data

US 2013/0045143 A1 Feb. 21, 2013

(51) Int. Cl.
*B01J 8/00* (2006.01)
*B01J 19/00* (2006.01)
(Continued)

(52) U.S. Cl.
CPC ..... *C10J 3/466* (2013.01); *C10J 3/506* (2013.01); *C10L 1/322* (2013.01); *C10L 1/324* (2013.01); *C10L 1/326* (2013.01); *C10J 2300/0903* (2013.01); *C10J 2300/0906* (2013.01); *C10J 2300/0913* (2013.01);
(Continued)

(58) Field of Classification Search
CPC ..... B01J 19/00; B01J 8/00; F27B 5/14; F27D 19/00; F27D 13/00
USPC ..... 422/198; 432/43, 120, 209, 37, 29
See application file for complete search history.

(56) References Cited

U.S. PATENT DOCUMENTS 3,506,564 A * 4/1970 Cone ..... 208/33
3,544,291 A * 12/1970 Schlinger et al. ..... 48/206
(Continued)

FOREIGN PATENT DOCUMENTS

CN 101613628 A 12/2009
JP 2004346107 A 12/2004
JP 2009067872 A 4/2009

OTHER PUBLICATIONS

Machine translation for JP-2009-067872A—Apr. 15, 2016.*
(Continued)

*Primary Examiner* — Huy-Tram Nguyen
(74) *Attorney, Agent, or Firm* — Fletcher Yoder, P.C.

(57) ABSTRACT

The disclosed embodiments relate to systems and methods for heating a slurry to increase a solids concentration of the slurry while maintaining the viscosity of the slurry below a threshold viscosity. For example, in one embodiment, a system includes a fuel slurry preparation system having a slurry tank configured to hold a fuel slurry, the fuel slurry having a solid fuel and a liquid. The fuel slurry preparation system also includes a heat source and a controller configured to control the heat source to heat the fuel slurry to decrease a viscosity of the slurry below a threshold viscosity.

15 Claims, 8 Drawing Sheets

(51) Int. Cl.

| | |
|---|---|
| ***F27B 5/14*** | (2006.01) |
| ***F27D 19/00*** | (2006.01) |
| ***C10J 3/46*** | (2006.01) |
| ***C10J 3/50*** | (2006.01) |
| ***C10L 1/32*** | (2006.01) |
| *F28D 21/00* | (2006.01) |

(52) U.S. Cl.

CPC ..... *C10J 2300/0973* (2013.01); *C10J 2300/1625* (2013.01); *C10L 2230/14* (2013.01); *C10L 2290/04* (2013.01); *C10L 2290/06* (2013.01); *F28D 2021/0098* (2013.01); *Y10T 137/0324* (2015.04); *Y10T 137/0391* (2015.04)

(56) References Cited

U.S. PATENT DOCUMENTS

| | | | | |
|---|---|---|---|---|
| 3,793,157 | A * | 2/1974 | Hobbs et al. | 203/2 |
| 4,151,744 | A * | 5/1979 | Hemmings | 73/54.01 |
| 4,282,006 | A * | 8/1981 | Funk | C10L 1/326 406/197 |
| 4,526,584 | A | 7/1985 | Funk | |
| 4,624,684 | A | 11/1986 | Stevenson | |
| 4,688,588 | A * | 8/1987 | Horsley | B65G 55/30 137/13 |
| 4,706,892 | A * | 11/1987 | Klose | B01F 15/00253 241/16 |
| 4,944,078 | A * | 7/1990 | Nakade | 28/183 |
| 5,234,468 | A * | 8/1993 | Khan | 48/197 A |
| 5,273,556 | A | 12/1993 | McMahon | |
| 5,685,153 | A * | 11/1997 | Dickinson | C02F 11/086 110/238 |
| 5,730,836 | A | 3/1998 | Greig et al. | |
| 6,132,478 | A * | 10/2000 | Tsurui et al. | 44/280 |
| 6,945,775 | B2 | 9/2005 | Fraser et al. | |
| 6,953,750 | B1 | 10/2005 | Wu et al. | |
| 2003/0079867 | A1* | 5/2003 | Chang et al. | 165/133 |
| 2007/0178807 | A1 | 8/2007 | Gupta et al. | |
| 2009/0194257 | A1* | 8/2009 | Niu et al. | 165/104.17 |
| 2010/0293918 | A1* | 11/2010 | Gulko et al. | 60/39.12 |
| 2011/0179712 | A1 | 7/2011 | Thacker et al. | |

OTHER PUBLICATIONS

European Search Report and Opinion issued in connection with corresponding EP Application No. 11871376.7 on Apr. 7, 2015.

PCT International Search Report ; PCT Application No. PCT/CN2011/001380; issued on May 24, 2012.

* cited by examiner

FUEL SLURRY HEATING SYSTEM AND METHOD

CROSS-REFERENCE TO RELATED APPLICATION

This application claims priority to and benefit of PCT Application No. PCT/CN2011/001380, entitled "FUEL SLURRY HEATING SYSTEM AND METHOD", filed Aug. 19, 2011, which is herein incorporated by reference in its entirety.

BACKGROUND

The subject matter disclosed herein relates to the preparation of fuel slurries used in gasification processes, and more specifically to increasing the concentration of solids in the fuel slurry.

Synthesis gas or "syngas" is a mixture of carbon monoxide (CO) and hydrogen ($H_2$) and other components present in lesser degrees, such as carbon dioxide ($CO_2$) that has a number of uses, such as in power generation, steam generation, heat generation, substitute natural gas (SNG) production, as well as chemical synthesis. Syngas can be produced using gasification processes, which utilize a solid, liquid, and/or gaseous carbonaceous fuel source such as coal, coke, oil, and/or biomass, to react with oxygen ($O_2$) to produce the syngas within a gasifier. While certain liquid and gaseous carbonaceous fuels may be provided to the gasifier directly, solid carbonaceous fuel sources are often provided to the gasifier as a fuel slurry, where the solid fuel is dispersed within a liquid, such as water. The liquid is used to facilitate flow of the solid fuel into the gasifier as well as to facilitate dispersal of the solid fuel within the gasifier, for example to increase gasification efficiency. Unfortunately, the presence of liquid in the slurry reduces the energy content of syngas produced per unit weight of feed as compared with other more concentrated fuel sources, such as liquid or gaseous feeds.

BRIEF DESCRIPTION

Certain embodiments commensurate in scope with the originally claimed invention are summarized below. These embodiments are not intended to limit the scope of the claimed invention, but rather these embodiments are intended only to provide a brief summary of possible forms of the invention. Indeed, the invention may encompass a variety of forms that may be similar to or different from the embodiments set forth below.

In a first embodiment, a system includes a fuel slurry preparation system having a slurry tank configured to hold a fuel slurry, the fuel slurry having a solid fuel and a liquid. The fuel slurry preparation system also includes a heat source and a controller configured to control the heat source to heat the fuel slurry to decrease a viscosity of the slurry below a threshold viscosity.

In a second embodiment, a system includes a controller configured to control a heat source to heat a fuel slurry having a solid fuel and a liquid. The fuel slurry is heated to allow a slurry tank to produce the fuel slurry at a solids concentration that is higher than would be obtained if the fuel slurry were not heated.

In a third embodiment, a method includes monitoring one or more parameters of a fuel slurry with a controller, wherein one or more parameters include a viscosity of the slurry, a solids concentration of the slurry, a temperature of the slurry, or any combination thereof, and the fuel slurry has a solid fuel and a liquid. The method also includes maintaining the fuel slurry below a viscosity threshold by heating the fuel slurry.

BRIEF DESCRIPTION OF THE DRAWINGS

These and other features, aspects, and advantages of the present invention will become better understood when the following detailed description is read with reference to the accompanying drawings in which like characters represent like parts throughout the drawings, wherein.

DETAILED DESCRIPTION

Figure 1:
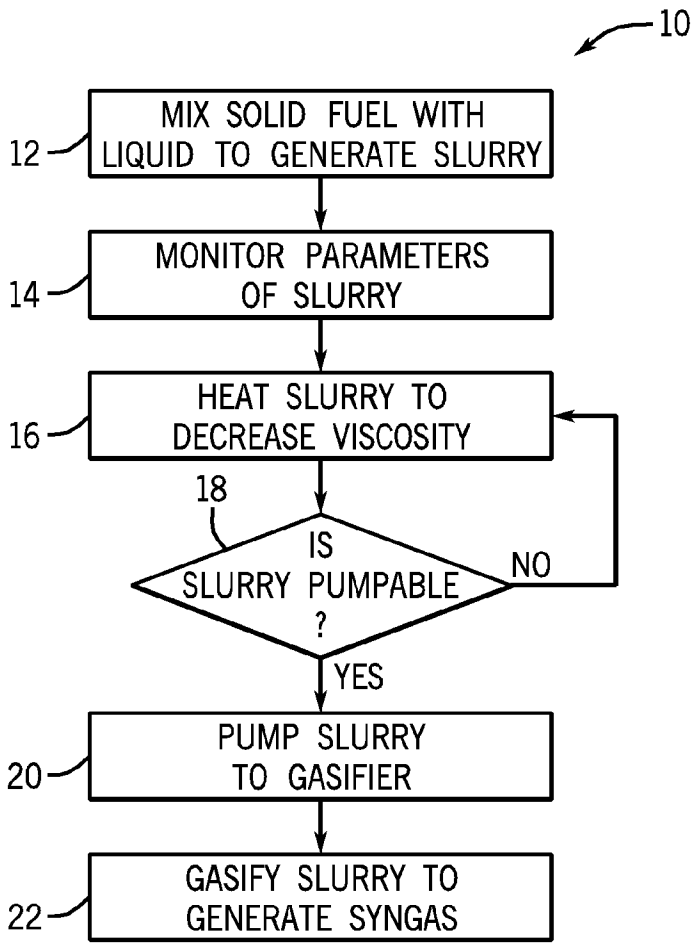
FIG. 1 is a process flow diagram illustrating an embodiment of a method for increasing a solids concentration of a slurry by heating the slurry.

One or more specific embodiments of the present invention will be described below. In an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present invention, the articles "a," "an," "the," and "said" are intended to mean that there are one or more of the elements. The terms "comprising," "including," and "having" are intended to be inclusive and mean that there may be additional elements other than the listed elements.

As noted above, some gasification systems use a slurry of solid fuel and a liquid (e.g., water) to deliver the solid fuel to a gasifier to produce syngas. The liquid of the fuel slurry facilitates the flow of the solid fuel to the gasifier, and can also aid in dispersing the solid fuel within the gasifier to increase gasification efficiency. However, the amount of syngas produced can be dependent, among other variables, on the amount of solid fuel within the reactor, and thus typical gasification systems are limited by the solids concentration of the fuel slurry that can be produced and pumped at a desired flow rate. Moreover, the viscosity of the slurry in such ambient conditions can have a detrimental effect on the equipment that produces the fuel slurry and the equipment that motivates the fuel slurry from a slurry preparation area to the gasifier. For example, agitators such as impellers within a slurry tank, conduits such as piping, as well as various pumps, feed injectors, and so forth may erode due to relatively high viscosity levels of the slurry compared to other fluids.

While the solids concentration of a slurry may be increased using certain additives such as fluxants, surfactants, and the like, such approaches may be unable to mitigate the undesirable effects of high viscosity slurries. Moreover, the solids concentration increase using such additives is often marginal, and can add cost to gasification processes. Accordingly, the present disclosure provides a fuel slurry preparation system that is configured to provide heating to the fuel slurry using steam or another heated fluid generated within the gasification system or elsewhere in a gasification plant. In one embodiment, a heat source may be placed in a slurry preparation tank. The heat source may receive waste steam or other heated fluid such as hot syngas or heated water from another process within the plant, which provides beneficial heating to the fuel slurry. The heating may allow for higher concentrations of solid within the fuel slurry, while maintaining the pumpability of the fuel slurry at a desired rate. Additionally, in some embodiments, the heating fluid (e.g., steam) may also be used as a feature for agitation of the fuel slurry in the slurry tank, which can reduce power requirements by agitation features within the slurry preparation tank. Indeed, such reductions in viscosity can also prolong the life of fuel slurry preparation and motivation equipment. Moreover, delivering preheated fuel slurry to the gasifier may decrease the specific fuel consumption (fuel per unit power) of both $O_2$ and the solid fuel used in the gasification reaction.

The embodiments described herein may be performed by a system, such as a slurry preparation system, that is a stand-alone system or integrated into a gasification/power production facility. For example, the slurry preparation systems described herein may be integrated with gasification processes, methanation processes, or other power or chemical production process that produces an amount of steam that can be utilized to achieve temperature increases in a fuel slurry. Moreover, certain of the methods for controlling the slurry heating features described herein may be performed by a controller, which may be an application-specific or a general-purpose computer having a memory, a processor, a data-accessing drive, and so on. The controller may be configured to execute certain routines, for example after accessing the routines on a machine-readable, non-transitory medium such as an optical disc, solid state memory, or the like. Alternatively or additionally, the controller may be connected to a distributed control system and/or a network, and may access the routines from a remote storage location. The controller may thereafter execute the routines to facilitate the heating and slurry concentration processes described herein. Non-limiting examples of embodiments of such control processes are described below with respect to FIGS. 1-4.

Figure 2:
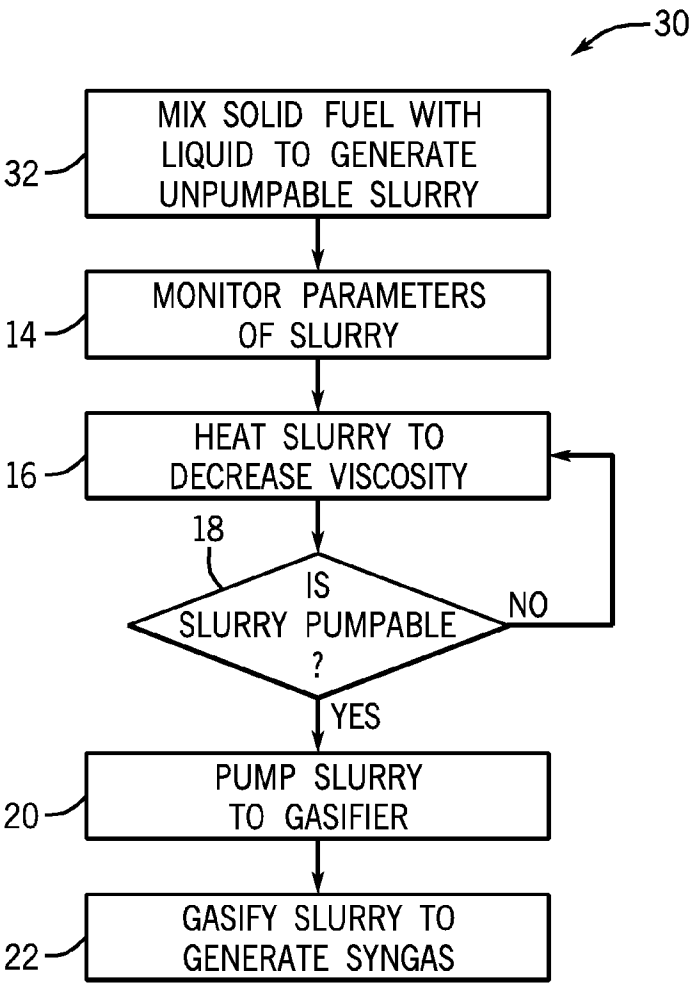
FIG. 2 is a process flow diagram illustrating an embodiment of a method for generating a pumpable slurry from an unpumpable slurry by heating the slurry.
Figure 3:
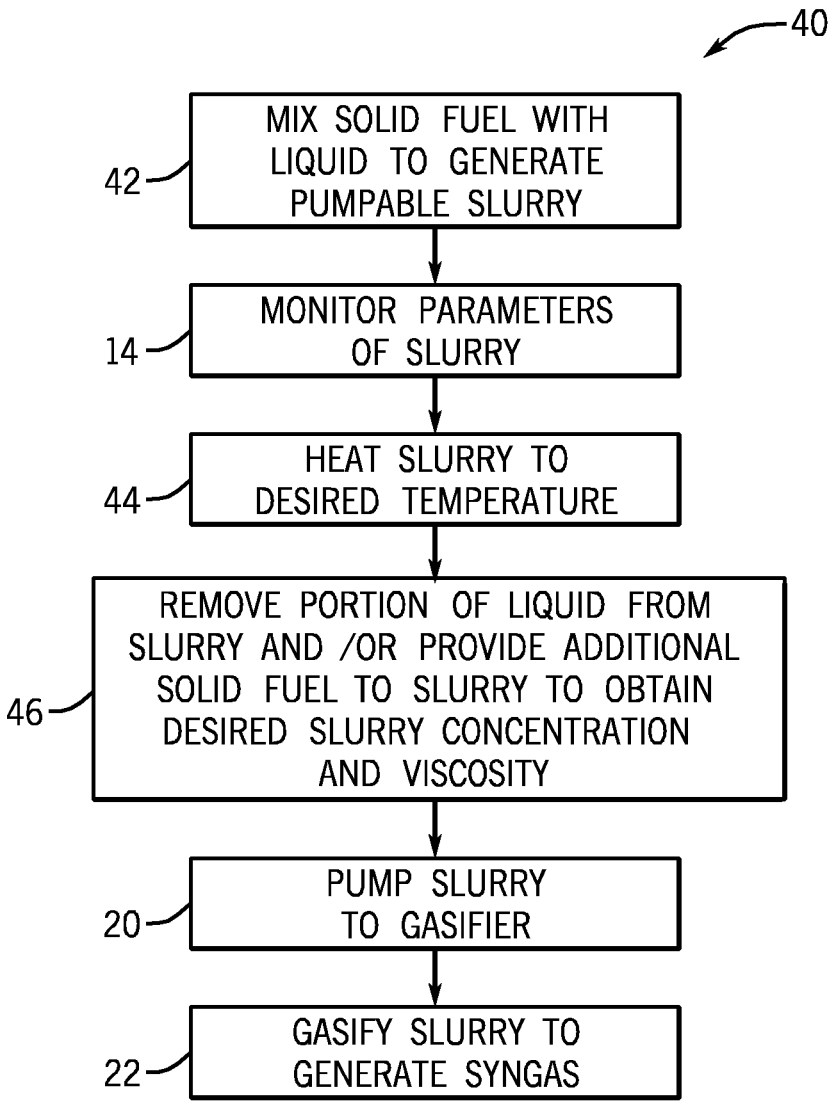
FIG. 3 is a process flow diagram illustrating an embodiment of a method for increasing a solids concentration of a slurry by heating the slurry and removing a portion of a liquid from the slurry.
Figure 4:
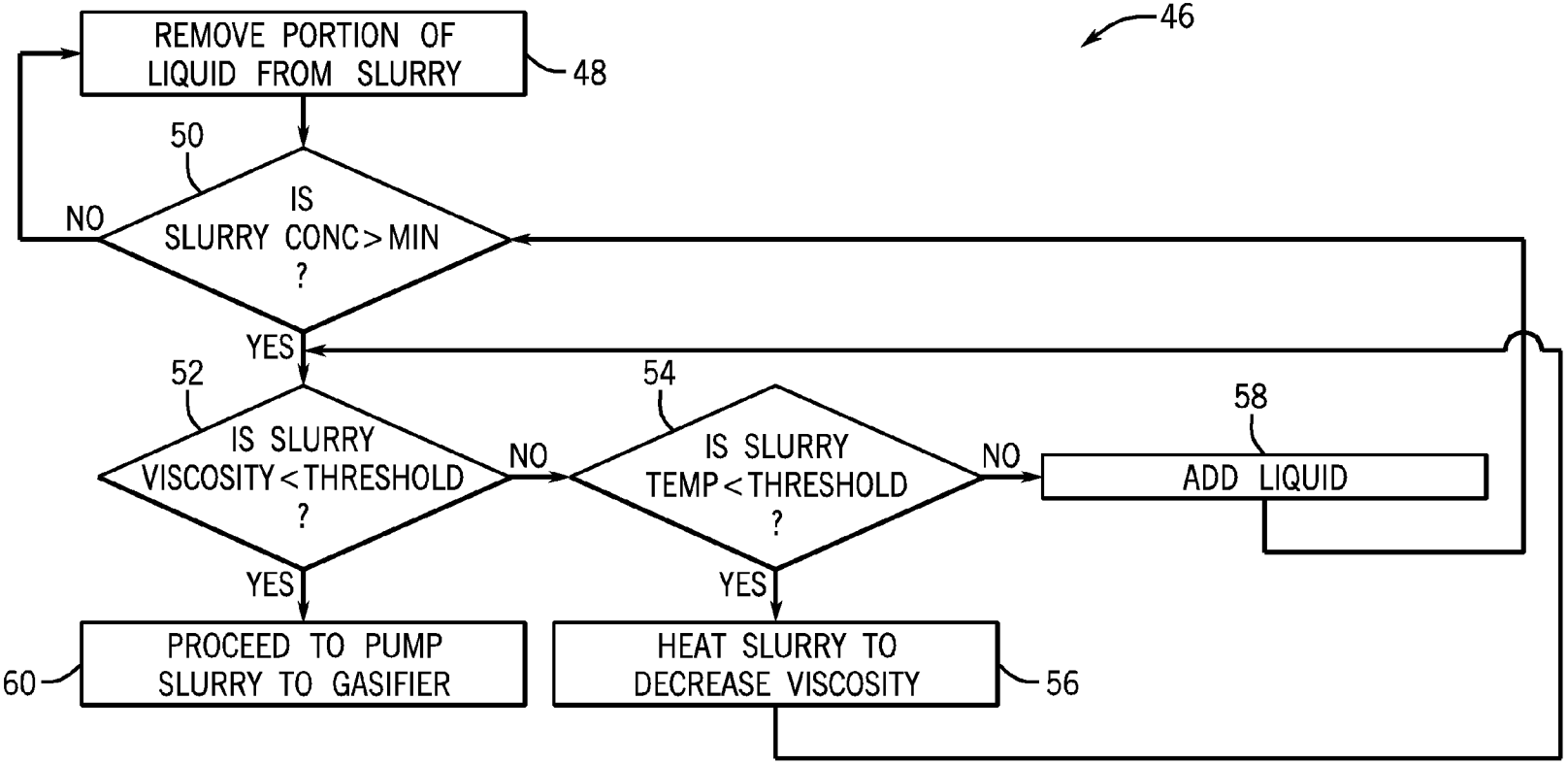
FIG. 4 is a process flow diagram illustrating an embodiment of a method for performing a liquid removal step of FIG. 3.

Keeping in mind that the methods set forth with respect to FIGS. 1-4 may be performed by any such suitably-configured controller as described above, FIG. 1 is a process flow diagram illustrating an embodiment of a general method 10 for heating a fuel slurry. Performing the method 10 allows a solids concentration of the fuel slurry to be increased while maintaining a viscosity of the fuel slurry below a predetermined viscosity. In some embodiments, the predetermined viscosity may be a threshold viscosity at which the viscosity of the fuel slurry transitions from being pumpable at a desired flow rate to being unpumpable at the desired flow rate by a suitably-configured fuel slurry pump.

Method 10 begins by preparation of a fuel slurry. Specifically, a solid fuel is mixed with a liquid to generate the fuel slurry (block 12). The solid fuel may include coal, petroleum coke, biomass, or other carbon containing solids items. The liquid may include any material that remains substantially in the liquid phase during the slurry preparation processes described herein. The liquid may include an organic liquid, an aqueous liquid, or mixtures thereof. As an example, the liquid may include one or more organic solvents, an aqueous solution, an aqueous solution having one or more surfactants, or mixtures thereof. In one embodiment, the liquid may be water. The mixing of the solid fuel and the liquid may occur in any suitably configured mixing vessel, such as a mill, a vessel with agitation features, or the like, as will be described in further detail below with respect to FIGS. 4-6.

Once the fuel slurry has been formed, various parameters of the slurry are monitored (block 14). Additionally, while the step of monitoring the various parameters is presented as occurring after generating the fuel slurry and prior to other steps of the method 10, it should be noted that the parameters may be monitored substantially continuously during the method 10, such that the controller may make adjustments and any other determinations when suitable. The parameters that may be monitored include a temperature, pressure, viscosity, solids concentration, or any combination thereof, of the fuel slurry. Again, as will be discussed below, a controller may monitor such parameters by substantially continuously or intermittently monitoring one or more control signals received from transducers placed within a slurry preparation system.

Upon initially monitoring the parameters of the slurry, the fuel slurry is heated (block 16). Generally, the fuel slurry is heated to a desired temperature that results in a viscosity of the fuel slurry that allows the fuel slurry to be pumpable using a fuel slurry pump while maximizing the solids concentration of the fuel slurry. The solids concentration of the fuel slurry is the amount of solid fuel per amount of total fuel slurry, which may be represented by weight percent, volume percent, moles, or any similar metric. The temperature to which the fuel slurry is heated may depend on a number of factors, such as the desired solids concentration, the conditions under which the fuel slurry will be heated (e.g., open air or in a conduit), and so on. Generally, the fuel slurry is heated to a temperature above approximately 40° C., such as to between 40° C. and 400° C. In embodiments in which the fuel slurry is heated in an open air vessel, the fuel slurry may be heated to a temperature up to about a temperature at which the liquid will boil, such between 50 and 100% of the temperature at which the liquid will boil (e.g., approximately 50, 60, 70, 80, 90, 95, 99, or 100% of the boiling point of the liquid). Thus, in embodiments in which the liquid is water, the fuel slurry may be heated to between about 40° C. and 100° C., such as between about 50° C. and 90° C., or 60° C. and 80° C. Thus, the fuel slurry may be heated to approximately 45° C., 50° C., 55° C., 60° C., 65° C., 70° C., 75° C., 80° C., 85° C., 90° C., 95° C., or 99° C. Moreover, it should be noted that the fuel slurry may be heated to or slightly above (e.g., up to about 15° C. above) 100° C. if the fuel slurry contains materials that allow boiling point elevation of the water.

In embodiments in which the slurry is heated in a closed system, such as within a conduit or other closed fluid-transferring feature, the liquid may be heated above about 40° C. and up to a temperature below a threshold temperature at which the fuel slurry may begin to coke (i.e., the coking temperature). Indeed, in some embodiments, the slurry may be heated to between approximately 10% and 99%, or 20 and 90%, or 30 and 80%, or 40 and 60%, of the coking temperature, such as approximately 10, 20, 30, 40, 50, 60, 70, 80, 90, 95, or 99% of the coking temperature. In embodiments in which the fuel slurry is heated in a closed system and the liquid is water, the fuel slurry may be heated to between approximately 40 and 300° C., or 50 and 250° C., or 60 and 240° C., or 70 and 230° C., or 80 and 220° C., or 90 and 200° C., such as 50° C., 60° C., 70° C., 80° C., 90° C., 100° C., 125° C., 150° C., 175° C., 200° C., 225° C., 250° C., or 260° C.

As noted above, the fuel slurry is heated to a desired temperature that reduces the viscosity of the fuel slurry below a threshold viscosity of the fuel slurry. Again, the threshold viscosity may be defined as the viscosity at which the fuel slurry transitions from being pumpable under a given set of conditions to being unpumpable under the given set of conditions. The given set of conditions may include being able to be pumped at a given rate by certain types of pumps having certain specifications, and the pumps are configured to motivate (e.g., pump) the fuel slurry through a slurry conduit. In some embodiments, the threshold viscosity may depend on these and other factors, which may be determined experimentally and/or based upon specifications of a given fuel slurry and pump. As an example, the threshold viscosity may be between approximately 1 $kg \cdot m^{-1} \cdot s^{-1}$ (1 Pascal second (Pa·s)) and 2 $k \cdot m^{-1} \cdot s^{-1}$, such as 1.1, 1.2, 1.3, 1.4, 1.5, 1.75, 2 $kg \cdot m^{-1} \cdot s^{-1}$, or higher, depending at least on the factors above. Indeed, the fuel slurry may be heated to allow a concentration such that the viscosity of the fuel slurry is between approximately 10% and 99%, or 20 and 90%, or 30 and 80%, or 40 and 60%, of the threshold viscosity. Such higher concentrations may allow increased syngas output per unit time, decreased liquid waste, higher plant efficiency, and so forth, compared to configurations where the fuel slurry is not heated.

Thus, after heating the fuel slurry, and based upon the considerations described above, the controller may determine whether the slurry is pumpable based on the monitored parameters (query 18). In embodiments where the slurry is not able to be pumped (e.g., is not below a threshold viscosity) at query 18, the method 10 may cycle back to heating the slurry until a desired pumpability is reached. Decreasing the viscosity of the fuel slurry in this manner may reduce wear on plant components, may reduce the required power to pump the fuel slurry, may reduce the size of pumping equipment, and may increase the maximum solids concentration of a given fuel slurry. In embodiments where the fuel slurry is pumpable at query 18, the method 10 may progress to pumping the fuel slurry to a gasifier (block 20). Once the slurry is provided to the gasifier, at least the solid fuel within the slurry is gasified to produce a syngas (block 22). As noted above, by heating the fuel slurry, the operation of the gasification system to produce syngas may be more efficient. For example, the inventors have calculated that larger amounts of syngas may be produced by gasifying a heated fuel slurry feed compared to gasifying a non-heated fuel slurry feed.

The present embodiments, in addition to the general method described above, also provide approaches to generate a pumpable slurry from an unpumpable slurry, as depicted by the process flow diagram of FIG. 2. Specifically, the process flow diagram of FIG. 2 illustrates an embodiment of a method 30 for generating a pumpable slurry from an unpumpable slurry by applying heat to the unpumpable slurry.

As noted with regard to the general method 10 described above, the fuel slurry may be heated to a temperature that reduces the viscosity of the fuel slurry below a threshold viscosity of the fuel slurry. Therefore, in the context of the present embodiment, the method 30 provides for a reduction in the viscosity of the fuel slurry from a value above the threshold viscosity to a value below the threshold viscosity. In accordance with certain embodiments, the viscosity of the fuel slurry is dependent on the solids concentration of the slurry as well as the viscosity of the liquid of the fuel slurry. Decreasing the viscosity of the liquid of the fuel slurry decreases the viscosity of the fuel slurry. Indeed, the solids concentration of the fuel slurry may be increased by adding more solid fuel to the slurry while decreasing the viscosity of the liquid by adding heat to the slurry. In this way, the solids concentration of the fuel slurry may be increased while maintaining the viscosity of the fuel slurry at a desired level by applying heat to reduce the viscosity of the liquid. Therefore, by heating the fuel slurry, a higher solids concentration may be achieved than the solids concentration that would be achieved if the fuel slurry were not heated.

Keeping the above viscosity relationships in mind, method 30 begins with generating an unpumpable slurry (block 32). The unpumpable slurry is generated by mixing the solid fuel and the liquid in a ratio that produces the fuel slurry at a viscosity at ambient temperature (e.g., up to about 40° C.) that is above the threshold viscosity. As an example, in embodiments where the liquid is water, the solid fuel and the liquid may be provided in a ratio so as to generate a fuel slurry having a solids concentration of at least 60 weight percent (wt. %), where the weight of the solid fuel accounts for about 60 percent of the total weight of the slurry. Indeed, in certain embodiments, the unpumpable slurry may have a solids concentration between approximately 60 and 70 wt %, or 61 and 69 wt %, or 62 and 68 wt %, or 63 and 67 wt %, or 64 and 66 wt %, such as approximately 60 wt %, 61 wt %, 62 wt %, 63 wt %, 64 wt %, 65 wt %, 66 wt %, 67 wt %, 68 wt %, 69 wt %, 70 wt %, or higher.

Upon generating the unpumpable slurry, the method 30 performs the acts represented by blocks 14-22 as described above with respect to FIG. 1. Generally, the method 30 proceeds to monitor parameters of the fuel slurry (block 14), such as viscosity, temperature, solids concentration, and the like. The fuel slurry is then heated to reduce its viscosity (block 16), such as below a desired threshold viscosity. The method 30 proceeds to determine whether the slurry is pumpable (query 18). For example, a controller or similar feature may determine whether the fuel slurry is no more than approximately 99% of the threshold viscosity, such as between about 10% and 95%, or 20 and 90%, or 30 and 80%, or 40 and 70%, or 50 and 60%, of the threshold viscosity. In embodiments where the slurry is pumpable at query 18, the method proceeds to pumping the fuel slurry to the gasifier (block 20). The fuel slurry is then gasified (block 22). However, in embodiments where the fuel slurry is not pumpable (e.g., is at or above 100% of the threshold viscosity) at query 18, the method may return to the acts represented by block 16.

Using certain of the approaches described above, it may be desirable to increase the solids concentration of the fuel slurry by removing water from the slurry, rather than first generating an unpumpable slurry and heating the slurry to make the slurry pumpbale. Such an approach may be desirable, for example, in situations where an unpumpable slurry may be difficult to generate, monitor, and/or process. FIG. 3 illustrates a process flow diagram of an embodiment of a method 40 for increasing the solids concentration of the fuel slurry by removing water.

The method 40 begins by generating a pumpable slurry by mixing the solid fuel with the liquid (block 42). The fuel slurry may be so generated by mixing the solid fuel with the liquid in a ratio such that the viscosity of the fuel slurry is below the threshold viscosity. As an example, in embodiments where the liquid is water, the initial solids concentration of the fuel slurry may be at or below approximately 60 wt %, such as between approximately 1 wt % and 60 wt %, or 10 and 50 wt %, or 20 and 40 wt %. The fuel slurry having such an initial concentration may be considered a first fuel slurry.

The parameters of the first slurry are monitored as described above with respect to FIG. 1 (block 14), and the first slurry is then heated to a desired temperature (block 44). The desired temperature may be a modeled temperature based at least upon the initial solids concentration, the desired final solids concentration, and the desired final viscosity of the fuel slurry. Again, as noted above, in embodiments where the fuel slurry is heated in an open-air system, the desired temperature may be approximately 40° C. and 100° C., such as between about 50° C. and 90° C., or 60° C. and 80° C. In embodiments where the fuel slurry is heated in a closed system, the desired temperature may be approximately between 40 and 300° C., or 50 and 250° C., or 60 and 240° C., or 70 and 230° C., or 80 and 220° C., or 90 and 200° C.

Once the fuel slurry has been heated to the desired temperature, a portion of the liquid may be removed from the fuel slurry and/or an additional amount of solid fuel may be added to the fuel slurry to obtain the desired solids concentration and viscosity of the fuel slurry (block 46), which may be referred to as a second fuel slurry. As an example, between approximately 1% and 50% of the total liquid may be removed, such as between approximately 1 and 50%, or 2 and 50%, or 3 and 40%, or 4 and 30%, or 5 and 20% of the total liquid may be removed. In embodiments where additional solid fuel is added to the fuel slurry, between approximately 1 and 50% more solid fuel may be added, such as between approximately 1 and 30%, 5 and 25%, or 10 and 20% more solid fuel. An embodiment of a method for performing the liquid removal acts represented by block 46 is discussed in detail below with respect to FIG. 4. In embodiments where additional fuel slurry is provided (in addition to or in lieu of liquid removal), the amount of additional solid fuel may be added based on viscosity measurements, temperature measurements, solids concentration measurements, or a combination thereof. Once the second fuel slurry has been generated, the second fuel slurry is pumped to the gasifier (block 20), where at least the solid fuel is gasified to generate the syngas (block 22).

FIG. 4 illustrates a process flow diagram of an embodiment of the method 46 for generating the second fuel slurry when it is desirable to remove liquid from the fuel slurry to obtain a particular solids concentration. The method 46 begins by removing a portion of liquid from the first fuel slurry (block 48). The amount of liquid removed from the first fuel slurry may depend at least partially on the initial solids concentration and the desired final solids concentration, the temperature of the initial fuel slurry, as well as the threshold viscosity for the fuel slurry. The removal of the liquid may be performed by liquid vaporization, for example to generate steam, or by performing a separation of a portion of the liquid from the solid fuel based on size, density, or other property. As an example, the liquid may be separated from the solid fuel using a filter and a valve, a cyclone, a membrane, an absorbent material, or a combination of such features or similar features.

Once the portion of the liquid has been removed, the controller may determine whether the fuel slurry has a solids concentration above a desired minimum solids concentration (query 50). In embodiments where the fuel slurry does not have a sufficient solids concentration, the method 46 may cycle back to the acts represented by block 48, and another portion of liquid may be removed. In embodiments where the solids concentration of the fuel slurry is above a desired minimum, the method 46 progresses to determine whether the viscosity of the fuel slurry is below the threshold viscosity (query 52). In embodiments where the viscosity of the fuel slurry is above the threshold viscosity (e.g., if more liquid was removed in block 48 than is suitable), the method 46 then proceeds to determine whether the fuel slurry has reached a temperature threshold (query 54), which may be at least partially determined by the considerations described above with respect to FIG. 1. In embodiments where the fuel slurry is below the temperature threshold, the fuel slurry is heated (block 56). The method then returns to query 52. In embodiments where the slurry is at or above the temperature threshold, additional liquid is added to the fuel slurry (block 58). The method then returns to query 50. Returning to query 52, in embodiments where the viscosity of the fuel slurry is below the threshold viscosity, the method 46 progresses to the acts represented by block 20 of FIG. 3 (block 60).

Figure 5:
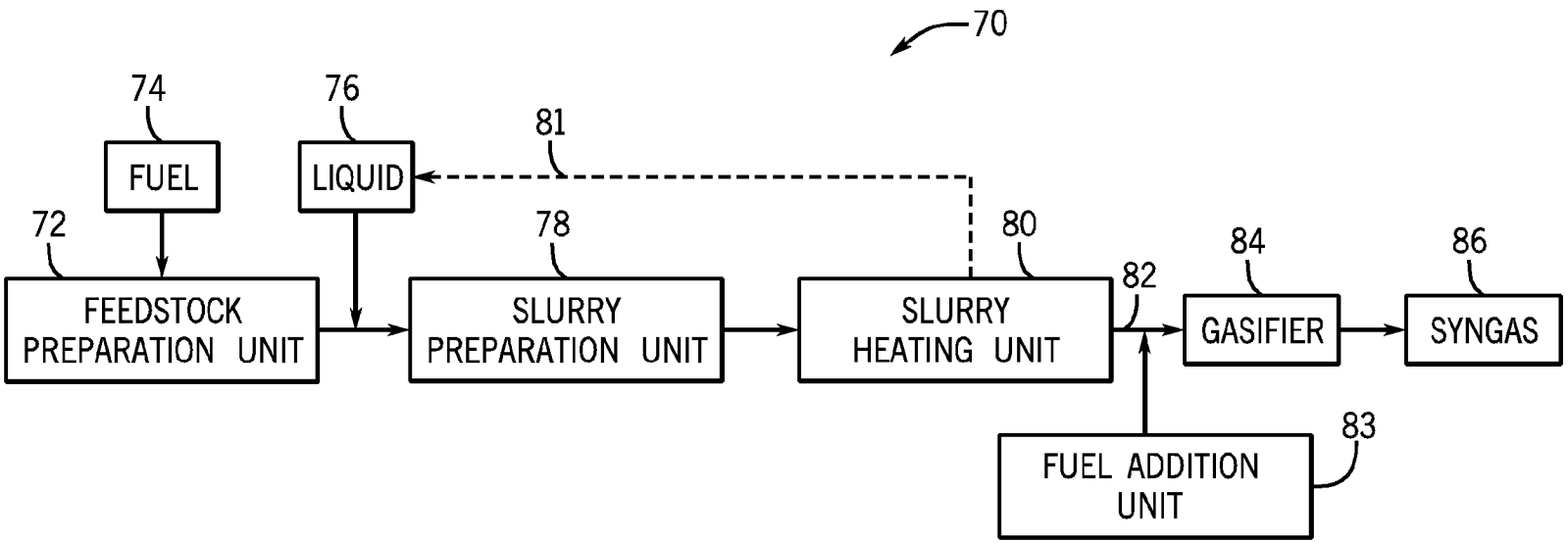
FIG. 5 is a block diagram illustrating an embodiment of a slurry preparation system.

The methods described above, as previously mentioned, may be performed by a suitably-configured controller operatively connected to various slurry preparation features. The slurry preparation features may be a part of a gasification system, integrated into the gasification system, or may otherwise be a standalone portion of a gasification system. FIG. 5 illustrates a block diagram of an embodiment of a system 70 that uses slurry heating features and/or solid fuel addition features to beneficially increase the solids concentration of a fuel slurry. The system 70 includes a feedstock preparation unit 72 that receives a solid fuel 74 and prepares the solid fuel 74 for mixing with a liquid 76. As an example, the feedstock preparation unit 72 may include a grinder, a mill, or any similar vessel that is capable of producing smaller particles from large particles of the solid fuel 74. As illustrated, the liquid 76 is introduced to the solid fuel 74 downstream of the feedstock preparation unit 72. However, in other embodiments, the liquid 76 may be introduced directly into the feedstock preparation unit 72.

A slurry preparation unit 78 configured to receive the solid fuel 74 and the liquid 76 is disposed downstream from the feedstock preparation unit 72. The slurry preparation unit 78 may be a vessel having one or more agitation features such as a grinder, an impeller, a sonication unit, or the like. The slurry preparation unit 78, in a general sense, mixes the solid fuel 74 and the liquid 76 to generate a fuel slurry. In accordance with the disclosed embodiments, the slurry preparation unit 78 is connected to or otherwise disposed upstream of a slurry heating unit 80 and a fuel addition unit 83. The slurry heating unit 80 is configured to provide a source of heat (e.g., steam or other heated fluid) to the fuel slurry to increase the temperature of the fuel slurry so as to allow a solids concentration of the fuel slurry to be increased. In embodiments using heated water or steam as the heat source, the slurry heating unit 80 may provide a recycle or make-up steam flow 81 (e.g., water and/or steam) as a source of the liquid 76. The flow 81 also may be used to preheat the liquid 76 upstream of the slurry preparation unit 76. In certain embodiments, the slurry heating unit 80 may be partially or completely contained within the slurry preparation unit 78.

Additional solid fuel 74 may be added to a fuel slurry stream 82 containing the solid fuel 74 and the liquid 76, after being prepared by the slurry preparation unit 78 and the slurry heating unit 80. In the illustrated embodiment, the system 70 also includes the fuel addition unit 83, which is configured to provide additional solid fuel 74 to the stream 82, in addition to or in lieu of liquids removal, to increase the solids concentration of the stream 82. The additional fuel, as noted above with respect to FIG. 3, may be added based on viscosity, pumpability, flow velocity, concentration, or similar measurements. After the stream 82 has been adjusted to a desired concentration range, the system directs the stream 82 to a gasifier 84. The gasifier 84 is configured to subject the fuel slurry stream 82 to gasification conditions. As a result of being subjected these conditions, the solid fuel within the fuel slurry stream 82 reacts with oxygen ($O_2$) and water ($H_2O$) to generate syngas 86. In a general sense, the amount of syngas 86 that is produced is limited by, among other things, the size of the gasifier 84 as well as the amount of solid fuel 74 that enters the gasifier 84.

As noted above, because the solid fuel 74 is provided to the gasifier 84 as a part of the fuel slurry stream 82, it may be desirable to maximize the amount of solid fuel 74 contained within the fuel slurry stream 82. The amount of solid fuel 74 contained within the fuel slurry stream 82 may be considered to be a solids concentration of the fuel slurry 82. Again, the solids concentration of the fuel slurry 82 may be advantageously increased by heating the solid fuel 74 and the liquid 76 with the slurry heating unit 80. An embodiment of a slurry preparation and heating system 90 is diagrammatically illustrated in FIG. 6. The system 90 includes a mill 92 having an inlet 93 for receiving the solid fuel 74 and prepares the solid fuel 74 for slurrying. As an example, the mill 92 may be a ball mill, a grinding mill, or any similar feature or combination of features for reducing the particle size of the solid fuel 74. In some embodiments, by reducing the particle size, the solid fuel 74 may be more easily dispersed within the liquid 76, which, in the illustrated embodiment, is water. In addition to receiving the solid fuel 74, the mill 92 is also configured to receive other additives 94, such as fluxants, catalysts, and so on. A water supply 96 feeds water into the mill 92 via conduit 98. The mill 92 further includes an outlet 100 for discharging a mixture of the solid fuel 74, the liquid 76, and the additive 94 into a mill discharge tank 102.

The system 90 also includes a controller 104 that is communicatively connected to a first transducer 106 configured to generate signals representative of an amount of solids within the mill 92, a temperature of the solids within the mill 92, and the like. The controller 104 is also communicatively connected to a second transducer 108 configured to generate signals representative of an amount of solids exiting the mill 92, a temperature of the material exiting the mill 92, a viscosity of the material exiting the mill 92, and the like. The controller 104 is also operatively connected to an actuator 110 of a flow control valve 112 disposed along the conduit 98. The controller 104 is configured to adjust a flow rate of the water through the conduit 98 by adjusting the position of the flow control valve 112 via the actuator 110. The controller 104 sends signals to the actuator 110 to perform such adjustments in response to received signals from the first and/or second transducers 106, 108 that indicate measured parameters outside of a desired range.

In addition to the features described above for grinding and, to a certain extent, mixing the solid fuel 74 with other slurry components, the system 90 also includes features for slurrying the solid fuel 74 as well as heating the resulting fuel slurry. The system 90 includes a transfer pump 114 for motivating a pre-mix of solid fuel 74 and other slurry components to a mixing vessel 116 (e.g., a slurry tank). The mixing vessel 116 includes one or more features configured to agitate and suspend the solid fuel 74 within the water to produce a fuel slurry. In the illustrated embodiment, the mixing vessel 116 includes an impeller 118 having blades for mixing and agitating the solid fuel 74 within the water.

The mixing vessel 116 also includes a heat source configured to provide heat to the fuel slurry while the fuel slurry is in the vessel 116. Specifically, in the illustrated embodiment, the heat source is a perforated applicator 120 (e.g., a manifold, grid, or tube) having a plurality of orifices for allowing a heated fluid (e.g., steam) 122 to escape the perforated applicator 120 to heat the fuel slurry, depicted generally as arrows. Advantageously, as the steam 122 escapes the perforated applicator 120 to directly heat the fuel slurry, the steam 122 provides additional agitation to the fuel slurry by sparging. The perforated applicator 120 receives the steam 122 from a steam source 124 by way of a conduit 126.

The controller 104 is coupled to various features disposed on and/or within the mixing vessel 116 and the conduit 126 to enable heating of the fuel slurry to a desired temperature. For example, the controller 104 may be configured to adjust the heat transfer to the fuel slurry by the perforated applicator 120 (or other heat source) to adjust the solids concentration and viscosity of the fuel slurry between upper and lower thresholds. The controller 104 is coupled to a third transducer 128 disposed on and/or within the mixing vessel 116, which enables monitoring of the temperature, solids concentration, and/or viscosity of the fuel slurry as it is generated and heated in the mixing vessel 116. Additionally, the controller 104 is coupled to a fourth transducer 130 that enables the controller 104 to monitor a temperature of the steam 122 as it flows through the conduit 126. The controller 104 is operatively coupled to an actuator 132 of a flow control valve 134 disposed along the conduit 126 to enable the controller 104 to adjust a flow rate of the steam 122 through the conduit 126. Adjusting the flow rate of the steam 122 adjusts the amount of steam 122 that escapes the perforated applicator 120, and therefore adjusts the rate at which the fuel slurry is heated. Thus, the controller 104 is capable of providing more or less heat to the fuel slurry in response to monitored temperatures and/or solids concentrations of the fuel slurry within the mixing vessel 116.

After the fuel slurry has been prepared and heated as described above, at least a portion of the fuel slurry is discharged to a slurry pump 136. The slurry pump 136 is configured to motivate the generated fuel slurry at a desired flow rate. Indeed, as noted above, the desired solids concentration of the fuel slurry may depend at least on the specifications of the slurry pump 136 and the capability of the slurry pump 136 to motivate the fuel slurry at the desired flow rate. Therefore, the controller 104 is connected to a fifth transducer 138 that may generate and send signals representative of a flow rate and/or viscosity of a fuel slurry 140 that is sent to a gasifier. Accordingly, the monitored parameters of the fuel slurry 140 that is sent to the gasifier may also be a factor for determining a desired temperature and/or solids concentration of the fuel slurry.

Figure 6:
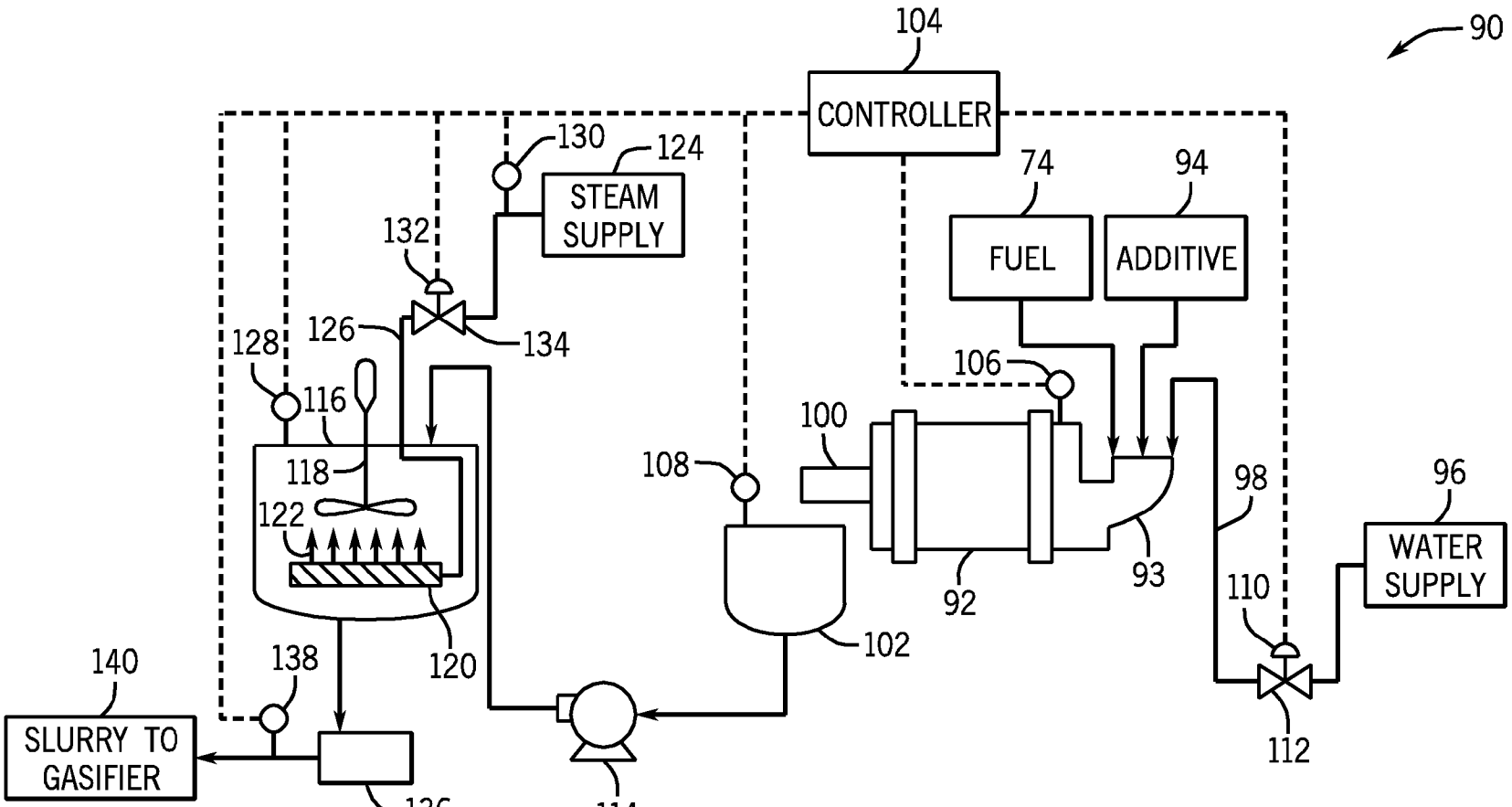
FIG. 6 is a schematic diagram illustrating an embodiment of the slurry preparation system of FIG. 5 having a heat source configured to allow steam to sparge the slurry within a slurry preparation tank.
Figure 7:
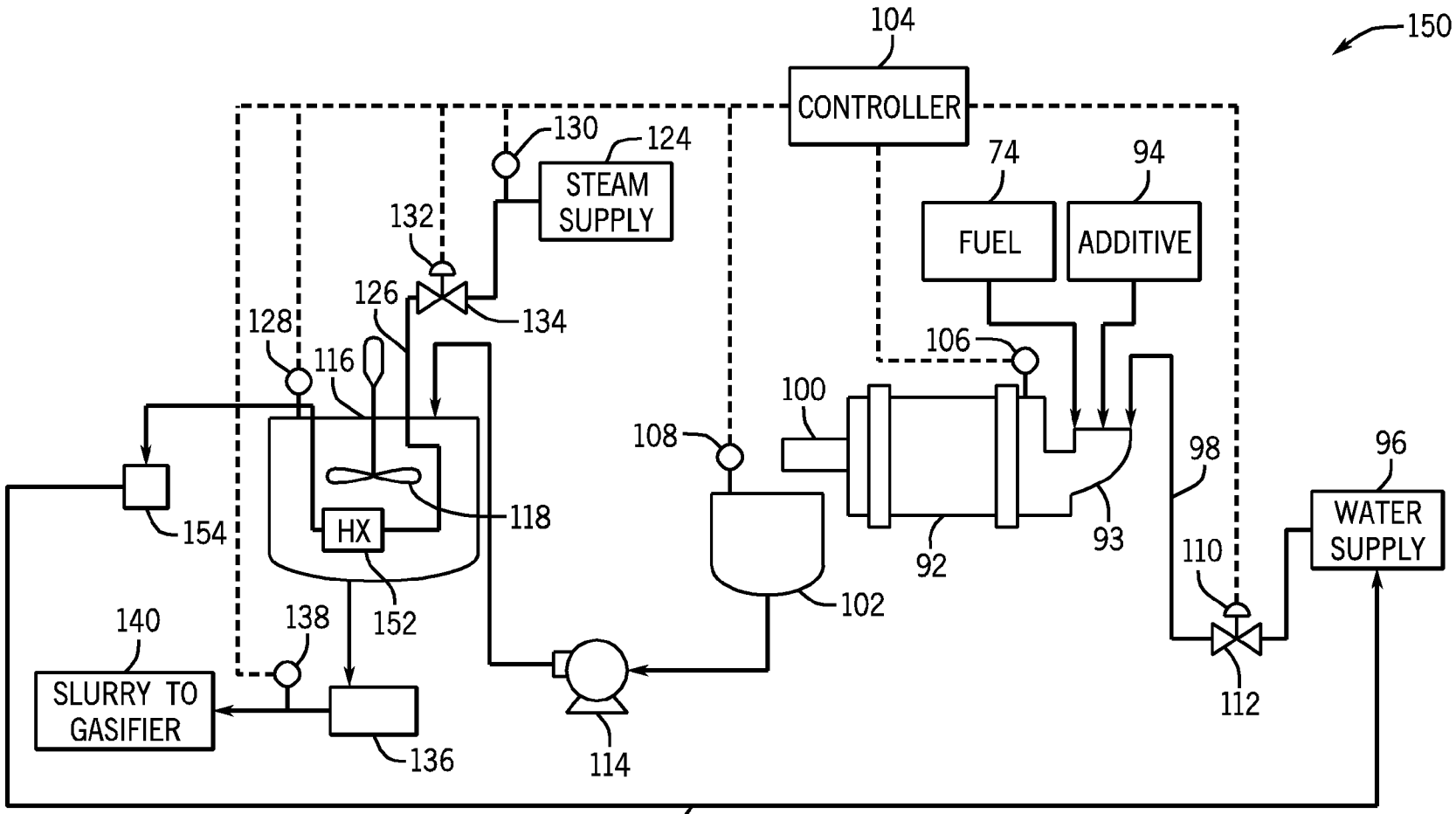
FIG. 7 is a schematic diagram illustrating another embodiment of the slurry preparation system of FIG. 5 having a heat exchanger disposed within a slurry preparation tank to heat the slurry.

While the embodiment illustrated in FIG. 6 depicts the system 90 as including the perforated applicator 120 for providing direct contact between the steam 122 and the fuel slurry to heat the fuel slurry, it may be desirable, alternatively or additionally, to have a feature for providing indirect heating to the fuel slurry. Accordingly, FIG. 7 is a diagrammatical representation of a system 150 having a heat exchanger 152 disposed within the mixing vessel 116. The heat exchanger 152 may include any shape, size, or other configuration suitable for receiving a feed of steam through the conduit 126. In certain embodiments, the heat exchanger 152 may be configured to maximize a surface area of the heat exchanger 152 that is exposed to both the steam and the fuel slurry. For example, the heat exchanger 152 may be a coil that is disposed proximate the impeller 118 for providing an indirect heating source to the fuel slurry. After the steam begins to cool within the heat exchanger 152, or in a substantially continuous fashion, the cooled steam (and/or condensed water) may be provided to a pump 154 or another similar feature for sending a recycle stream 156 to the water supply 96 (e.g., a water tank or other boiler feedwater source).

Figure 8:
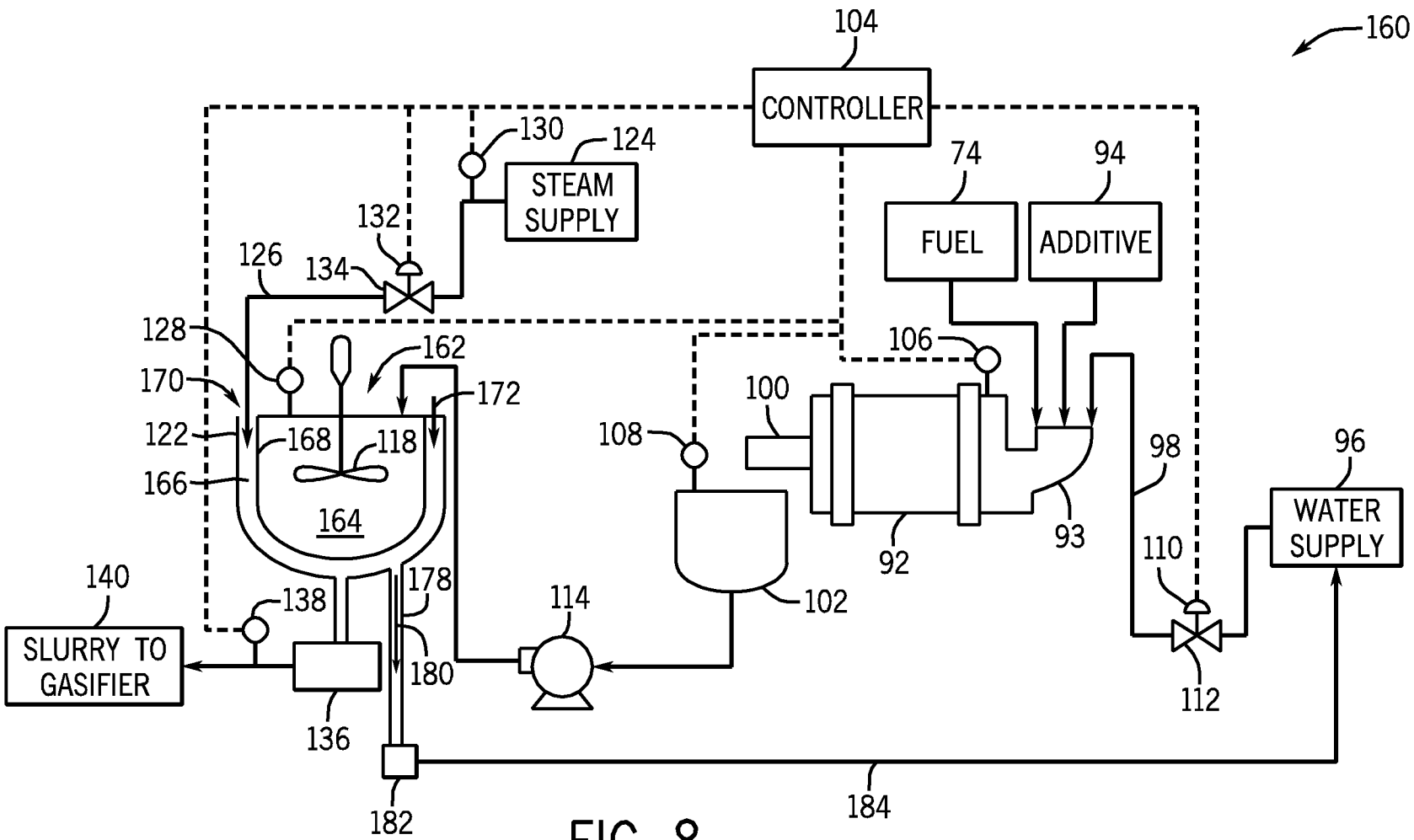
FIG. 8 is a schematic diagram illustrating another embodiment of the slurry preparation system of FIG. 5 having a steam jacket disposed about a slurry preparation tank to heat the slurry.

In other embodiments, it may be desirable to heat the fuel slurry while the fuel slurry is in the mixing vessel 116 without interfering with (or extending into the path of) mixing of the fuel slurry by the impeller 118. For example, such features may be desirable to avoid erosion of conduits (e.g., piping), heat exchangers, tubing, and so forth. Therefore, FIG. 8 is a diagrammatical illustration of a system 160 having a jacketed mixing vessel 162. The jacketed mixing vessel 162 includes an interior portion 164 where the fuel slurry is generated and agitated, as well as an external portion defining a heating jacket 166, which is an annular structure surrounding the interior portion 164 where the fuel slurry is produced.

The heating jacket 166 is generally configured to receive the steam 122 from the steam supply 124, and enables an interior surface 168 of the interior portion 166 to heat the fuel slurry within the mixing vessel 162. The steam 122 enters the heating jacket 166 at an inlet area 170, and may progress to other areas 172 of the jacket 166. The steam 122, after undergoing heat transfer to the surface 168, may condense and be removed via conduit 178. A stream of condensate 180 is then directed to a condensate pump 182, which motivates (e.g., pumps) the stream 180 as a recycle stream 184 to the water supply 96.

Figure 9:
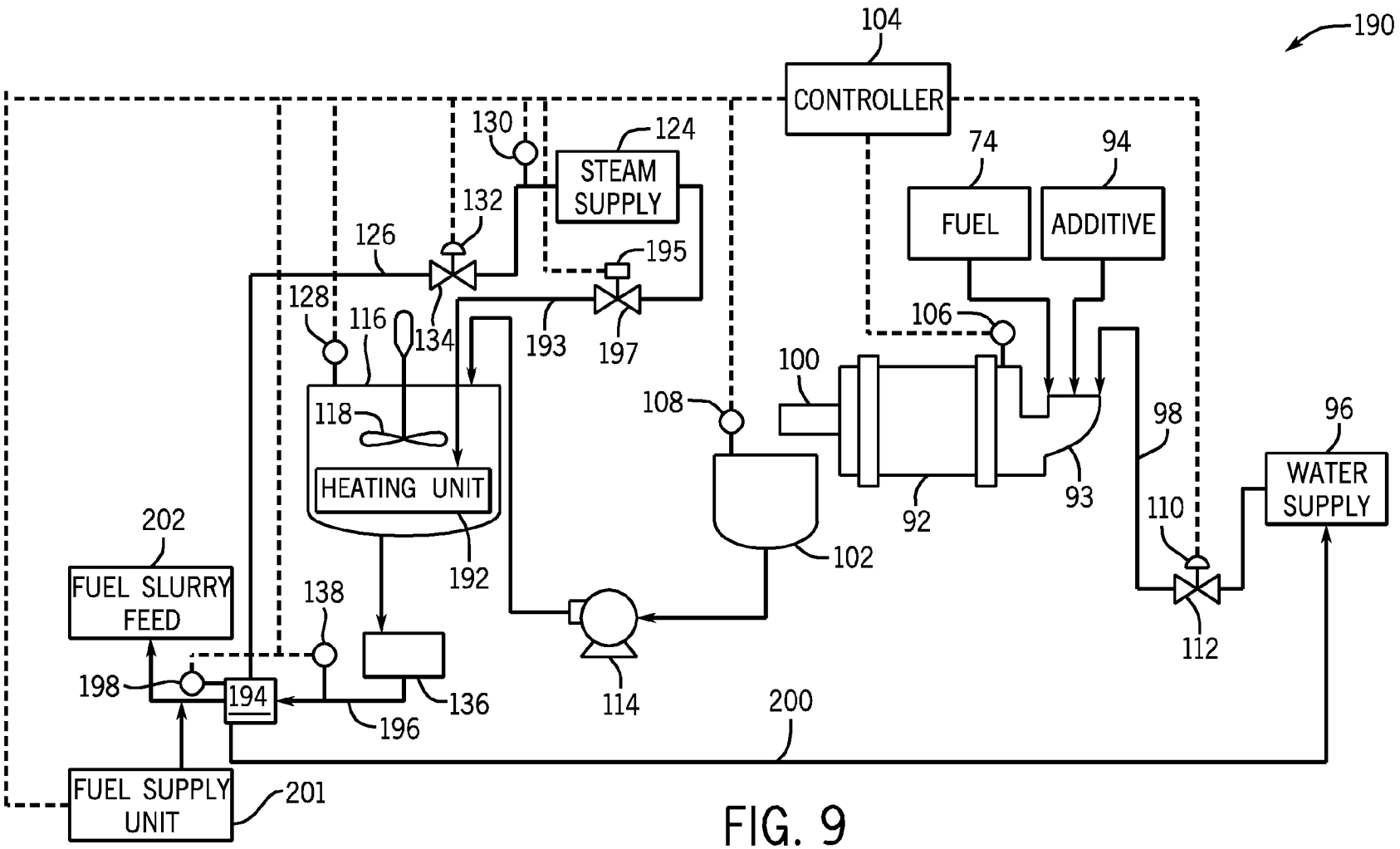
FIG. 9 is a schematic diagram illustrating another embodiment of the slurry preparation system of FIG. 5 having water removal features disposed downstream of a slurry preparation tank to increase a solids concentration of a heated slurry.

As discussed above with respect to the method 40 of FIG. 3, it may be desirable to initially generate a pumpable slurry (i.e., before heating), and remove the liquid of the fuel slurry or add additional fuel to the fuel slurry during and/or after heating. FIG. 9 illustrates an embodiment of a system 190 having a general heating unit 192, which may include any one or a combination of the embodiments of a heat source discussed above with respect to FIGS. 6-8, as well as a heat exchanger/liquid removal unit 194 for increasing a solids concentration of a generated fuel slurry. In embodiments where the heating unit 192 is used to heat the slurry in the mixing vessel 116, steam or other heated fluid (e.g., oil, hot syngas) is provided via a conduit 193. The flow rate of the steam to the heating unit 192 is controlled by the controller 104, which sends control signals to an actuator 195 of a flow control valve 197 to adjust the position of the valve 197.

After the fuel slurry is initially formed, and, in some embodiments, heated in the mixing vessel 116, the generated slurry is pumped by the slurry pump 136 through a conduit 196. As noted above, the controller 104 may monitor one or more parameters of the generated fuel slurry using the fifth transducer 138. Indeed, the solids concentration of the generated fuel slurry in conduit 196 may be lower than is desired. Accordingly, the generated fuel slurry is provided to the heat exchanger/liquid removal unit 194, where the fuel slurry is further heated and a portion of the water of the fuel slurry is removed. In removing a portion of the water, the solids concentration of the fuel slurry is increased.

The controller 104 may then monitor various parameters of the fuel slurry at the heat exchanger/liquid removal unit 194 using a sixth transducer 198. For example, the sixth transducer 198 may generate signals representative of a viscosity of the fuel slurry, the solids concentration of the fuel slurry, the temperature of the fuel slurry, the flow rate of the fuel slurry, or any combination thereof, of the fuel slurry. Indeed, the sixth transducer 198 may generate signals representative of any measurement that may represent, directly or indirectly, a solids concentration and/or pumpability of the fuel slurry. In response to receiving these signals, the controller 104 may adjust the amount of steam (or other heated fluid such as oil or syngas) provided to the heat exchanger/liquid removal unit 194. Moreover, the heat exchanger/liquid removal unit 194 may include various features that allow water to be removed, such as a vaporization chamber, a gas-liquid interface region for stripping the liquid with a stream of gas, or the like, that is heated by the heat exchanger portion of the heat exchanger/liquid removal unit 194. In embodiments in which a portion of the water is removed, the water, along with any steam condensate, is sent along a conduit 200 to the water supply 96 as recycle. In certain embodiments, as noted above with respect to FIGS. 3 and 5, it may be desirable to provide additional solid fuel 74 to the slurry after being heated. Indeed, in addition to, or in lieu of removing water from the fuel slurry to increase the solids concentration of the same, the controller may direct a fuel supply unit 201 to provide additional solid fuel 74 to the fuel slurry at an area of the system 190 downstream from the mixing vessel 116. The fuel supply unit 201 may be a hopper or any such feature capable of providing a solid feed to the fuel slurry. Again, the additional solid fuel 74 may be added based on viscosity, pumpability, flow velocity, concentration, or similar measurements of the fuel slurry. For example, these or similar measurements may be made by the sixth transducer 198, and signals representative of these measurements are provided to the controller 104, which is capable of directly or indirectly determining the solids concentration and/or the pumpability of the fuel slurry. The controller 104, as a function of these determinations, sends control signals to the fuel supply unit 201 to provide a certain amount of additional solid fuel 74 to the fuel slurry.

In some embodiments, the heat exchanger/liquid removal unit 194 may allow the steam that is used for heating to also be used as make-up liquid for the fuel slurry. For example, in situations where it may be desirable to add liquid back to the fuel slurry, such as when the viscosity of the fuel slurry is above the threshold value, the heat exchanger/liquid removal unit 194 may recycle at least a portion of the steam back to the fuel slurry. In embodiments where the fuel slurry does not flow through the heat exchanger/liquid removal unit 194 in a substantially continuous fashion, the heat exchanger/liquid removal unit 194 may also include pumping features. After the fuel slurry has the desired specifications (e.g., solids concentration, temperature), it is provided to the gasifier as fuel slurry feed 202.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

The invention claimed is:

1. A system, comprising:

a fuel slurry preparation system, comprising:

a grinding mill configured to receive a solid fuel and a liquid, to reduce a particle size of the solid fuel, and to mix the solid fuel with the liquid to form a first fuel slurry having a first solids concentration;

a closed vessel disposed downstream from and fluidly coupled to the grinding mill, wherein the closed vessel is configured to receive the first fuel slurry from the grinding mill and to hold the first fuel slurry;

a heat source coupled to the closed vessel and to a steam source in a gasification plant, the heat source being configured to receive steam generated in the gasification plant, wherein the heat source is configured to heat the first fuel slurry;

a fuel supply unit disposed downstream from the grinding mill, the closed vessel, and the heat source, wherein the fuel supply unit is configured to provide an additional amount of solid fuel to the first fuel slurry downstream of the closed vessel to adjust a solids concentration of the first fuel slurry and generate a second fuel slurry having a second solids concentration that is greater than the first solids concentration;

a control system configured to control the heat source to heat the first fuel slurry while the first fuel slurry is in the closed vessel to decrease a viscosity of the first fuel slurry below a threshold viscosity, within the closed vessel and the control system is configured to control the additional amount of solid fuel provided to the first fuel slurry by the fuel supply unit in response to a monitored viscosity or solids concentration of the first fuel slurry; and a gasifier fluidly coupled to the closed vessel, wherein the gasifier is configured to receive the second fuel slurry and gasify the second fuel slurry to produce syngas.

2. The system of claim 1, wherein the heat source is disposed along an output flow path external to the vessel.

3. The system of claim 1, wherein the heat source comprises a steam sparging applicator configured to output a flow of steam into the vessel to directly contact the first fuel slurry in the vessel.

4. The system of claim 1, wherein the heat source comprises a heat exchanger disposed in the vessel.

5. The system of claim 1, wherein the heat source comprises a heating jacket configured to at least partially surround the vessel.

6. The system of claim 1, comprising a slurry pump configured to receive the first fuel slurry from the vessel, and the threshold viscosity is at a transition between a pumpable viscosity and an unpumpable viscosity of the first fuel slurry by the slurry pump.

7. The system of claim 1, wherein the control system is configured to control the heat source to adjust heat transfer to the first fuel slurry to adjust a solids concentration and a viscosity of the first fuel slurry between upper and lower thresholds.

8. The system of claim 7, comprising a liquid removal unit disposed downstream from the closed vessel and configured to remove an amount of liquid from the first fuel slurry to adjust at least one of a viscosity or a solids concentration of the first fuel slurry, wherein the control system is configured to control the amount of liquid removed from the first fuel slurry by the liquid removal unit.

9. The system of claim 8, wherein the control system is configured to monitor the viscosity or a solids concentration of the first fuel slurry, and to adjust the heat source, the liquid removal unit, or a combination, in response to a change in at least one of the viscosity or the solids concentration.

10. A system, comprising:

a grinding mill configured to receive a first solid fuel and a liquid, to reduce a particle size of the first solid fuel, and to mix the first solid fuel with the liquid to form a first fuel slurry;

a fuel slurry preparation vessel configured to receive the first fuel slurry from the grinding mill and prepare the first fuel slurry, wherein the first fuel slurry has a viscosity above an upper viscosity threshold;

a control system configured to monitor one or more parameters of the first fuel slurry, wherein the one or more parameters comprise a viscosity of the first fuel slurry and a solids concentration of the first fuel slurry;

a fuel supply unit disposed downstream from the grinding mill and between the fuel slurry preparation vessel and a gasifier, wherein the fuel supply unit is configured to provide a second solid fuel to the first fuel slurry downstream of the fuel slurry preparation vessel to adjust the solids concentration of the first fuel slurry and generate a second fuel slurry; and wherein the control system is configured to control the second solid fuel provided to the first fuel slurry by the fuel supply unit in response to a monitored viscosity or solids concentration of the first fuel slurry upstream of the fuel supply unit and to adjust heat transfer to the first fuel slurry to reduce the viscosity below the upper viscosity threshold, and wherein the upper viscosity threshold is at a transition between a pumpable viscosity and an unpumpable viscosity of the first fuel slurry by a slurry pump configured to pump the first fuel slurry toward the gasifier.

11. The system of claim 10, wherein the control system is configured to adjust the heat transfer to adjust the viscosity between the upper viscosity threshold and a lower viscosity threshold.

12. The system of claim 10, where in the control system is configured to adjust the heat transfer to adjust the solids concentration between a lower concentration threshold and an upper concentration threshold.

13. The system of claim 10, wherein the control system is configured to monitor the viscosity and the solids concentration of the first fuel slurry, and the control system is configured to adjust heat transfer to the first fuel slurry by the heat source in response to a change in the viscosity or the solids concentration.

14. The system of claim 10, wherein the system comprises the heat source, the heat source comprises a steam flow path, and the control system is configured to control a steam flow through the steam flow path to control the heat transfer to the first fuel slurry.

15. The system of claim 10, wherein the gasifier is configured to receive the second fuel slurry at the viscosity below the upper viscosity threshold and the solids concentration above the lower concentration threshold.

* * * * *